United States Patent [19]

Temmesfeld

[11] Patent Number: 4,756,279

[45] Date of Patent: Jul. 12, 1988

[54] CONTROL ARRANGEMENT FOR THE COOLING AIR OF AIR-LIQUID-COOLED INTERNAL-COMBUSTION ENGINES, PARTICULARLY MOTOR VEHICLES

[75] Inventor: Axel Temmesfeld, Bad Feilnbach, Fed. Rep. of Germany

[73] Assignee: Bayerische Motoren Werke A.G., Munich, Fed. Rep. of Germany

[21] Appl. No.: 902,412

[22] PCT Filed: Dec. 17, 1985

[86] PCT No.: PCT/EP85/00713

§ 371 Date: Oct. 1, 1986

§ 102(e) Date: Oct. 1, 1986

[87] PCT Pub. No.: WO86/03803

PCT Pub. Date: Jul. 3, 1986

[30] Foreign Application Priority Data

Dec. 21, 1984 [DE] Fed. Rep. of Germany ..... 3446950

[51] Int. Cl.[4] ..... F01P 11/10

[52] U.S. Cl. ..... 123/41.04; 123/198 E

[58] Field of Search ..... 123/41.04, 41.05, 41.06, 123/198 E

[56] References Cited

U.S. PATENT DOCUMENTS

| | | | |
|---|---|---|---|
| 1,170,730 | 2/1916 | Benjamin et al. | 123/41.05 |
| 1,823,141 | 9/1931 | Hendrickson | 123/41.04 |
| 1,949,009 | 2/1934 | Dintilhac | 123/41.04 |
| 2,729,202 | 1/1956 | Sanders | 123/41.04 |
| 3,854,459 | 12/1974 | Stimeling | 123/41.04 |
| 4,455,971 | 6/1984 | Kirchweger et al. | 123/198 E |
| 4,476,820 | 10/1984 | Nixon | 123/41.05 |

FOREIGN PATENT DOCUMENTS

| | | | |
|---|---|---|---|
| 160508 | 9/1983 | Japan | 123/41.04 |
| 174115 | 10/1983 | Japan | 123/198 E |

*Primary Examiner*—William A. Cuchlinski, Jr.
*Attorney, Agent, or Firm*—Barnes & Thornburg

[57] ABSTRACT

A control device for the flow of cooling air through an air-liquid radiator of an internal combustion engine comprising a fan frame mounted between the radiator and the fan and being part of a noise damper of the engine. A spring curtain is arranged in the fan frame between the radiator and the fan and isolates the noise damper of the radiator, except when the engine reaches high operating temperatures, which prevents the radiator from absorbing power and the engine from being directly air cooled, thus reducing the prewarming time of the engine.

15 Claims, 1 Drawing Sheet

CONTROL ARRANGEMENT FOR THE COOLING AIR OF AIR-LIQUID-COOLED INTERNAL-COMBUSTION ENGINES, PARTICULARLY MOTOR VEHICLES

BACKGROUND AND SUMMARY OF THE INVENTION

This invention relates to a control arrangement for the cooling air of air-liquid-cooled internal-combustion engines, particularly of motor vehicles, having an air-liquid radiator, a temperature-controlled cooling-air stopping element such as a rolling curtain, and a radiator fan arranged in sequence behind one another in a cooling-air flow-end channel, comprising a fan shroud, to an engine housing or engine space in cooling-air flow direction, the stopping element in the closed position closing the connecting openings between the cooling-air outlet of the radiator and the engine housing or engine space, wherein the stopping element in its closed position and the part of the flow-in channel connected to the stopping elements in flow direction, are components of the engine housing or engine space developed as a noise capsule, and wherein in the flow-end channel, outside the noise capsule between the radiator and the stopping element, a cooling-air outlet opening is arranged that leads to the outside and closes in the opposite direction to the stopping elements.

A known arrangement of this construction according to U.S. Pat. No. 1,170,730 has a air blocking element that is developed as a flap shutter or rotary slide and a radiator fan that at a distance is exposed behind it in flow direction of the cooling air. As a result, the air blocking element controls the cooling effect of the radiator. For a reduction of the cooling function of the radiator fan itself, this radiator fan is equipped with adjustable fan blades. The air blocking element, the radiator fan and the engine, in an open arrangement, are arranged at a distance behind one another in flow direction of the cooling air. Noise from the radiator fan, the engine and its driving connections as well as the removal of heat of the engine and the radiator can spread to all directions and therefore stress the environment and also extend the warm-up time after a cold start of the engine.

Another known arrangement is disclosed in U.S. Pat. No. 2,703,075.

On the basis of DE-PS No. 532 730, a stopping element for the radiator is known that is developed as a double curtain and reduces the heat dissipation of the radiator to both sides but has no effect on the noise and heat emission of the radiator fan and of the engine.

It is the objective of an invention to further develop the control arrangement of the initially mentioned construction in such a way that the noise and heat emission from the engine and the radiator fan are reduced.

As a result, the noise and heat emission, from a noise capsule that is substantially tight to all sides, when the air blocking element is closed, can be reduced considerably in the case of a cold engine and an engine operated at part load and thus especially always in cases when the noise emission especially in the case of Diesel engines is especially high and a high, damming of heat is especially advantageous for low wear as well as low fuel consumption and a low emission of harmful exhaust gas substances by means of a short warm-up phase.

Another object of the invention is the provision of a control arrangement for the cooling air of air-liquid-cooled internal-combustion engines, wherein a stopping element is developed to be largely airtight and wherein a fan has a fan shroud having a narrow annular gap that is largely free of return flow in the direction of the outer circumference of its running wheel. With such a configuration, when the stopping element is closed, largely a zero blower output of the fan is achieved so that for this purpose, despite the rigid driving connection with the engine, hardly any driving output is required and therefore the construction expenses of a fan coupling or an electric fan motor are not necessary.

It is another object of the invention to provide a control arrangement for the cooling air of air-liquid-cooled internal-combustion engines, wherein a stopping element is developed as a rolling curtain having a supporting screen that penetrates a fan shroud in transverse direction to the cooling-air flow direction and against which the rolling curtain rests in its closed position in cooling-air flow direction in order to make possible a high density effect and smaller dimensions than those of the radiator.

It is another object of the invention to provide a control arrangement for the cooling air of air-liquid-cooled internal-combustion engines, wherein a fan shroud has an approximately cylindrical shroud ring that in cooling-air flow direction connects directly to a supporting screen, and wherein the supporting screen has a rectangular shape projecting beyond the shroud ring, in approximately triangular areas of which, outside the shroud ring, ram-air passage openings are arranged in the fan shroud that are controlled by the rolling curtain and by ram-air flaps to permit a smaller overall length and at the same time a control of additional ram air openings by means of the rolling curtain.

It is another object of the invention to provide a control arrangement for the cooling air of air-liquid-cooled internal-combustion engines wherein a cooling-air outlet opening leading to the outside between a radiator and a stopping element has a return-flow flap that closes automatically when the stopping element is open and the fan is driven in order to extend the noise-reducing effect of the stopping element beyond the warm-up time of the engine to operating times in which the cooling air output is sufficient without the radiator fan, especially therefore at part load and low ambient temperature.

The operating temperature of the engine, in this case, when the air blocking element is closed, can be determined in the conventional way by means of a thermostat controlling the temperature of the cooling liquid. After the given cooling output is exhausted in this case, by means of a temperature switch controlled by the cooling liquid temperature, the component temperature of the engine and/or the air temperature in the engine space, the air blocking element can be opened and, if necessary, the radiator fan can also be put in operation. This then will result in the full cooling output and engine space ventilating function of conventional radiator fan arrangements with fan shroud and engine space noise capsule.

Further objects, features, and advantages of the present invention will become more apparent from the following description when taken with the accompanying drawings, which show for purposes of illustration only, an embodiment constructed in accordance with the present invention.

Figure 1:
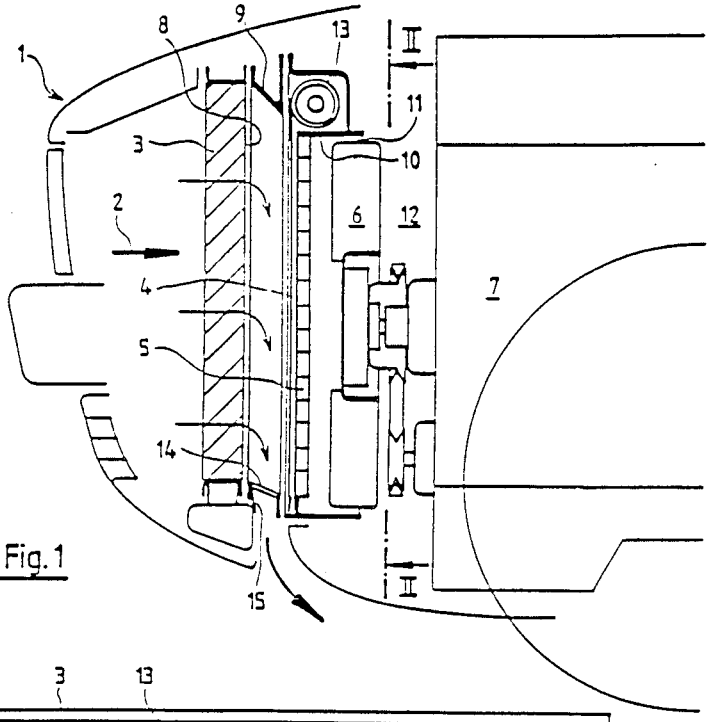
FIG. 1 is a partial longitudinal section through the front part of a motor vehicle having a control arrangement according to the invention for the cooling air to the radiator and to the engine space.
Figure 2:
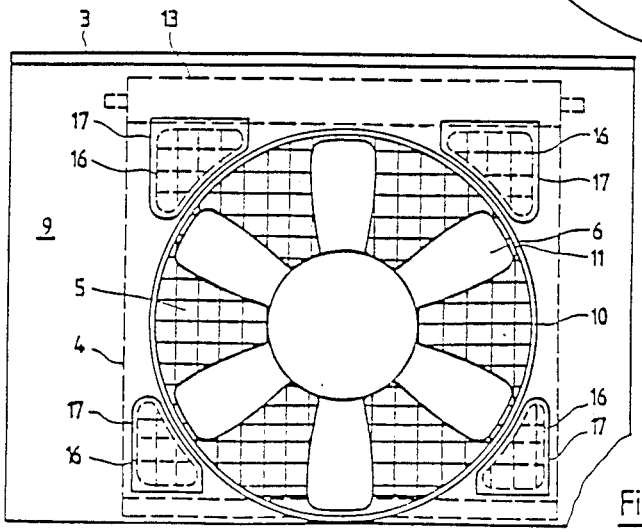
FIG. 2 is a partial top view of the control arrangement according to Line II—II in FIG. 1.

Referring now to the drawings wherein like reference numerals are used to designate like parts and more particularly to FIG. 1, in the front part 1 of a motor vehicle, an air-liquid-radiator 3, a air blocking element for the cooling air that is developed as a rolling curtain 4 having a support screen 5, a radiator fan 6 and an internal-combustion engine 7 are arranged behind one another in flow direction 2 of the cooling air. A fan shroud 9 connects to the cooling-air outlet 8 of the radiator 3 and ends in flow direction of the cooling air 2 in a shroud ring 10 that surrounds the outer circumference of the fan 6 with a narrow annular gap 11 that, when the rolling curtain 4 is closed, is largely without return flow and thus avoids producing output from the fan 6.

The support screen 5, that extends through the fan shroud 9, is arranged, in a space-saving way, directly in front of the shroud ring 10 in flow direction 2 of the cooling air, the rolling curtain 4 interacting with the support screen 5 for a largely airtight exclusion of a cooling air flow from the fan 6 and thus from the engine space 12 and prevents or blocks a noise emission in opposite direction from the engine space 12 and through the radiator 3 to the environment. For the latter purpose, the engine space 12 is also developed as a known noise capsule in a way that is not shown.

The rolling curtain 4 has a wind-up reel 13 above the shroud ring 10. Between the radiator 3 and the rolling curtain 4 or the support screen 5, at least one lower cooling-air outlet opening 14 having a return-flow flap 15 is arranged in the fan shroud 9, said cooling-air outlet opening leading out into the open and making possible a cooling effect of the radiator 3 for the partial-load operation of the engine 7 when the rolling curtain 4 is closed. The warm cooling-air flow from the radiator 4 in this case keeps the rolling curtain 4 from freezing in place and thus ensures its automatically controllable opening when a predetermined operating condition of the engine 7 is reached, such as high values of the ambient temperature, of the engine space temperature, of a component temperature, of the engine output and/or coolant temperature. In triangular areas of the fan shroud 9 and of the supporting screen 5 projecting beyond the shroud ring 10, ram-air openings 16 having ram-air flaps 17 are arranged that act in parallel with the shroud ring 10, said ram-air openings 16 resulting in a ram air flow that is in addition to the output of the fan 6 and is controlled by the rolling curtain 4.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A control arrangement for the cooling air of air-liquid-cooled internal combustion engines, particularly of motor vehicles, having an air-liquid radiator, a temperature-controlled cooling-air stopping element and a radiator fan which in the above sequence are arranged in a cooling-air flow-in channel to an engine housing or engine space in cooling-air flow direction behind one another, wherein the stopping element is arranged in a fan shroud connecting a cooling-air outlet of the radiator with the fan, the fan shroud and the stopping element are components of a noise capsule for the engine that is formed by the engine housing space, the stopping element is developed to be largely air-tight and wherein the fan shroud toward an outercircumference of the fan has a narrow annular gap means that is largely free of the return flow to prevent the radiator fan from circulating air from an exhaust area of the fan back to an inlet area of the fan.

2. A control arrangement for the cooling air of air-liquid-cooled internal combustion engines, particularly of motor vehicles, having an air-liquid radiator, a temperature-controlled cooling-air stopping element and a radiator fan which in the above sequence are arranged in a cooling-air flow-in channel to an engine housing or engine space in cooling-air flow direction behind one another, wherein the stopping element is arranged in a fan shroud connecting a cooling-air outlet of the radiator with the fan, the fan shroud and the stopping element are components of a noise capsule for the engine that is formed by the engine housing space, wherein the stopping element is developed as a rolling curtain having a supporting screen that penetrates the fan shroud transversely to the cooling-air flow direction and against which the rolling curtain rests in its closed position, in cooling-air flow direction (2).

3. An arrangement according to claim 2, wherein the fan shroud has an approximately cylindrical shroud ring (10) that in cooling-air flow direction connects directly to the supporting screen, and wherein the supporting screen has a rectangular shape projecting beyond the shroud ring, in the approximately triangular areas of which, outside shroud ring, ram-air passage openings are arranged in the fan shroud that are controlled by the rolling curtain and by ram-air flaps (17).

4. A control arrangement for the cooling air of air-liquid-cooled internal combustion engines, particularly of motor vehicles, having an air-liquid radiator, a temperature-controlled cooling-air stopping element and a radiator fan which in the above sequence are arranged in a cooling-air flow-in channel to an engine housing or engine space in cooling-air flow direction behind one another, wherein the stopping element is arranged in a fan shroud connecting a cooling-air outlet of the radiator with the fan, the fan shroud and the stopping element are components of a noise capsule for the engine that is formed by the engine housing space, wherein the fan shroud, between the radiator and the stopping element has cooling-air outlet openings having return-flow flaps, said cooling-air outlet openings leading to the outside.

5. A control arrangement for the cooling air of air-liquid-cooled internal-combustion engines, having an air-liquid radiator, a temperature-controlled cooling-air blocking means and a radiator fan which in the above sequence are arranged behind one another in a cooling-air flow-in channel to an engine housing space in cooling-air flow direction; the air blocking means, in the closed position, closing connecting openings between a cooling-air outlet of the radiator and the engine housing space; wherein the air blocking means in a closed position and a part of the flow-in channel connecting the air blocking means to the radiator fan in flow direction are components of the engine housing space developed as a noise blocking capsule means; and wherein the flow-in channel, outside the noise blocking capsule means between the radiator and the air blocking means, has a cooling-air outlet opening that leads to the outside when the air blocking means is in its closed position.

6. An arrangement according to claim 5, wherein the air blocking means is developed to be substantially airtight and wherein the fan has a fan shroud with a narrow annular gap between the fan and fan shroud that is largely free of return flow in the direction of the outer circumference of the fan.

7. An arrangement according to claim 6 wherein the cooling-air outlet opening leading to the outside between the radiator and the air-blocking means has a return-flow flap that closes automatically when the air-blocking means is open and the fan is driven.

8. An arrangement according to claim 5, wherein the air-blocking means is developed as a rolling curtain and a supporting screen penetrates the fan shroud in trransverse direction to the cooling-air flow direction and against which the rolling curtain rests in its closed position in cooling-air flow direction.

9. An arrangement according to claim 8, wherein the fan shroud comprises an approximately cylindrical shroud ring that in cooling-air flow direction connects directly to the supporting screen, and wherein the supporting screen has a rectangular shape projecting beyond the shroud ring, in the approximately triangular areas of which, outside the shroud ring; ram-air passage openings disposed in the fan shroud in flow alignment with the triangular areas; and wherein the ram-air passage openings are controlled by the rolling curtain and by ram-air flaps.

10. An arrangement according to claim 9 wherein the cooling-air outlet opening leading to the outside between the radiator and the air-blocking means has a return-flow flap that closes automatically when the air-blocking means is open and the fan is driven.

11. An arrangement according to claim 8 wherein the cooling-air outlet opening leading to the outside between the radiator and the air-blocking means has a return-flow flap that closes automatically when the air-blocking means is open and the fan is driven.

12. An arrangement according to claim 5 wherein the cooling-air outlet opening leading to the outside between the radiator and the air-blocking means has a return-flow flap that closes automatically when the air-blocking means is open and the fan is driven.

13. A cooling system for a combustion engine having a radiator means accepting air input and a fan means accepting air output from said radiator comprising: a curtain, a screen means disposed between the radiator means and the fan means for supporting said curtain, means for rolling the curtain into position between said radiator and said support screen to block said air output from the fan.

14. A cooling system in accordance with claim 13 further comprising means exhausting said air output from said radiator when said curtain is disposed in blocking position comprising a return-flow-flap means admitting passage of air from said radiator but blocking air passage in an opposite position.

15. A cooling system in accordance with claim 13 wherein said support screen and said curtain are configured substantially as a rectangle and said fan, during its rotation, sweeps a circle within said rectangle and further comprising ram-air passages disposed between said rectangle and said circle, the passages being blocked by the curtain in its blocking position, and ram-air passage flaps disposed to block said ram-air passages when said curtain is in its blocking position.

* * * * *